United States Patent [19]

Courshon, Jr. et al.

[11] 4,317,418

[45] Mar. 2, 1982

[54] TILE HANGER ASSEMBLY

[75] Inventors: Jacob B. Courshon, Jr., Park Forest; Nicholas G. Rutkay, Lake Forest, both of Ill.

[73] Assignee: Plibrico Company, Chicago, Ill.

[21] Appl. No.: 111,203

[22] Filed: Jan. 11, 1980

[51] Int. Cl.[3] ..... E06B 3/04; E04B 5/52

[52] U.S. Cl. ..... 110/331; 110/339; 248/227; 432/252; 52/489

[58] Field of Search ..... 110/331, 332, 335, 338, 110/339; 52/486, 489; 432/247, 248, 252; 248/227, 228

[56] References Cited

U.S. PATENT DOCUMENTS

| | | | |
|---|---|---|---|
| 1,751,675 | 3/1930 | Abbott | 110/332 |
| 2,387,663 | 10/1945 | Hosbein et al. | 110/339 |
| 2,446,766 | 8/1948 | Hosbein et al. | 110/331 |
| 2,657,651 | 11/1953 | Forsyth | 110/339 |
| 2,819,693 | 1/1958 | Rath | 110/339 |
| 3,181,487 | 5/1965 | Danke | 110/339 |
| 3,370,557 | 2/1968 | Birse | 110/339 |
| 3,431,693 | 3/1969 | Stephens | 110/331 |
| 3,596,864 | 8/1971 | Stephens | 110/331 |

*Primary Examiner*—Henry C. Yuen

*Attorney, Agent, or Firm*—Emrich, Root, Lee, Brown & Hill

[57] ABSTRACT

An anchor tile hanger for anchoring refractory brick to the roof of a furnace structure is comprised of a pair of vertically spaced apart plates having aligned cutouts in the upper edges which cutouts are adapted to engage the lower horizontal portion of a suspended I-beam. Attached to each of the ends of the vertically aligned plates are a pair of U-shaped rods each having a bight portion turned inwardly and facing one other which are adapted to engage and anchor the refractory tile or brick. The cutouts in the vertical disposed plates include overhang portions for positioning the tile hanger about the lower horizontal portions of the I-beam and clearance areas which facilitate assembly and insection of the tile hanger about the lower horizontal portion of the I-beam.

3 Claims, 6 Drawing Figures

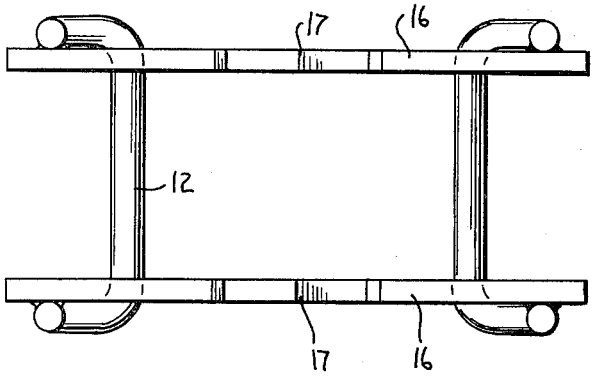
FIG. 3
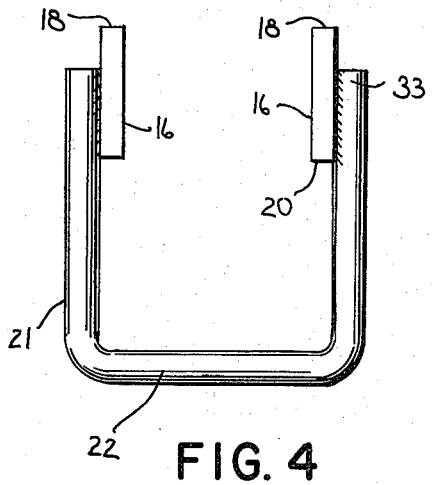
FIG. 4
FIG. 5
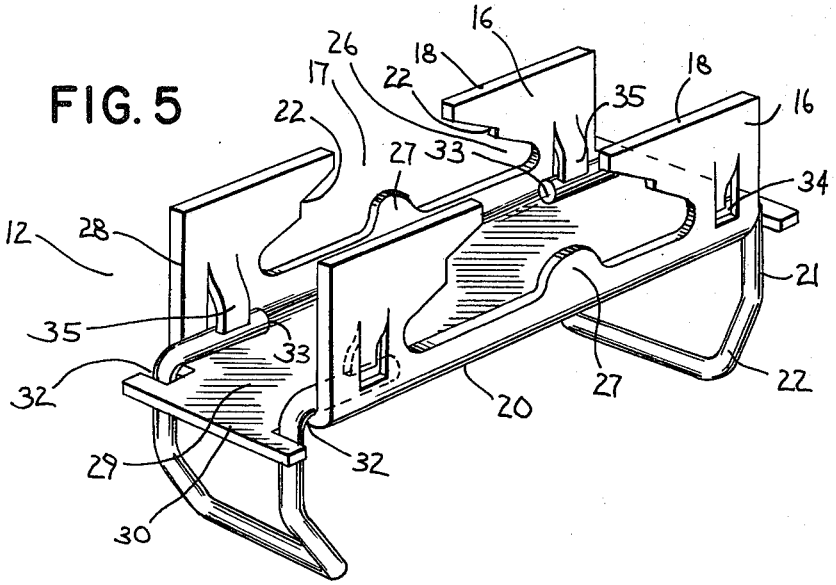
FIG. 6
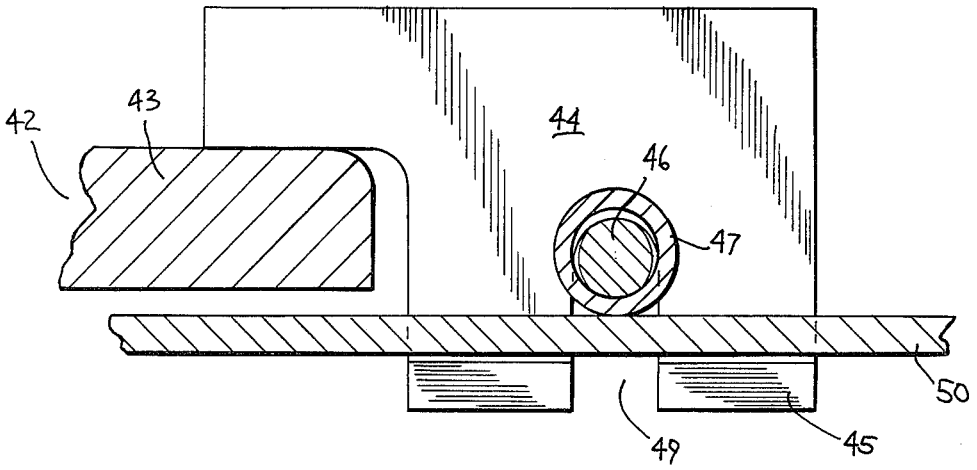

TILE HANGER ASSEMBLY

BACKGROUND OF THE INVENTION

The present invention relates to furnace arch or ceiling structures and particularly to tile hangers for suspending refractory brick or tiles to the roof of furnace structures.

The refractory tile material or brick used in the construction of the roof of a furnace is generally a castable refractory tile material which is suspended by attachment to the overhead steel structure. The spaces between the refractory tile or brick is then filled in with a plastic refractory material having the consistency of a thick putty which is installed by using a steel hammer or air rammer, or is filled in with a castable refractory material which is installed by prepared formwork. Once installed, the refractory material is baked to form a monolithic furnace roof lining. In constructing a ceiling or roof for a furnace structure with such refractory material, it is important that some means and method be provided for securing the refractory tile to the overhead steel structure in the furnace roof. One previously suggested tile hanger is disclosed in U.S. Pat. No. 3,596,864 and relates to a clip having two arms which are pivotally joined together so that they may be rotated to snugly envelop a flange on the I-beam.

Also, U.S. Pat. No. 2,657,651 describes a hanger construction comprised of a pair of stirrup members having hanger legs bent to form hook ends engageable over the I-beam flanges and opposite ends which are engageable with shoulders on the anchor tile.

Use of such tile hanger devices necessarily involves excessive time and labor in manually engaging the tile hanger to the overhead steel structure within the furnace roof. Also, when such hangers are assembled together, they have only limited application to specific I-beam constructions, a factor which has restricted their widespread application because of the necessity to require a plurality of sizes to accommodate variances in I-beam cross-sections. Moreover, such hanger devices are designed to rigidly attach to the suspended I-beam and do not provide flexibility to prevent damage to the refractory tile material during installation of the monolithic refractory material and upon extended periods of furnace operation, such designs have been found to be unacceptable because they are not reusable for periodic maintenance and repair work. Additionally, such rigidly attached tile hangers are not readily adaptable to contoured furnace ceilings or arches to meet specific requirements of the various furnace constructions and do not provide the necessary resiliency to resist expansion and vibration within the furnace structure. Accordingly, such devices have found only limited application as tile hangers.

THE INVENTION

It is one object of the present invention to provide an improved tile hanger assembly for attaching refractory tile to the overhead steel structure of a furnace assembly.

A further object of the present invention is to provide a tile hanger assembly having a minimum of parts which are inexpensive to produce, easy to assemble and install and which may be readily repaired with a minimum of labor and time in a furnace structure.

It is another object of the present invention to provide a tile hanger assembly which is adaptable to a plurality of sizes of I-beam cross-sections in furnace roof structures.

It is still a further object of the present invention to provide clamp members engageable with overhead steel structure for suspending I-beams for securing a refractory monolithic material in the furnace roof structure.

In accordance with one embodiment of the present invention, the tile hanger assembly is comprised of a pair of vertically spaced apart plates having aligned cutouts in their upper edges thereof which are adapted to engage the lower horizontal portion of an overhead I-beam structure in the roof or ceiling of a furnace structure. Welded to the ends of the two vertically spaced plates are a pair of U-shaped rods having a bight portion bent inwardly and facing one other which is engagable with the notched portions in the refractory tile material. The cutout portions on the vertically spaced plates are shaped to include overhang portions which engage the ends of the lower horizontal portion of the I-beam and includes clearance areas therein which facilitate positioning the tile hanger assembly over the lower horizontal portion of the I-beam.

When the roof or ceiling of the furnace structure does not include an existing overhead I-beam construction, an I-beam structure may be secured to the overhead steel structure by utilizing a clamp assembly having a pair of adjustably spaced leg extensions with inturned end portions which are adapted to receive and engage the upper horizontal portions of a suspended I-beam. The adjustably spaced leg extensions are attached to the overhead steel supporting structure by fastener means and a spacer so that the inturned leg portions snugly engage and support the upper horizontal portion of the I-beam.

The tile hanger assembly of the present invention provides for the positioning of refractory tile material lining into the contours of any furnace designed. The free standing engagement of the tile hanger assembly with the lower portion of the I-beam provides for a degree of flexibility which results in an improved monolithic lining which is heretofore been unknown in the art. Also, the simplicity of construction of the tile hanger provides for significant cost savings in material and labor in assembly.

DESCRIPTION OF THE DRAWINGS

FIG. 3 shows a top plan view of the tile hanger assembly in accordance with the present invention;

FIG. 4 is an end view of the tile hanger assembly in accordance with the present invention;

FIG. 5 is a perspective view of the tile hanger assembly in accordance with a further embodiment of the present invention; and FIG. 6 is a cross-sectional view taken along the lines 6—6 of FIG. 1.

DETAILED DESCRIPTION

Figure 1:
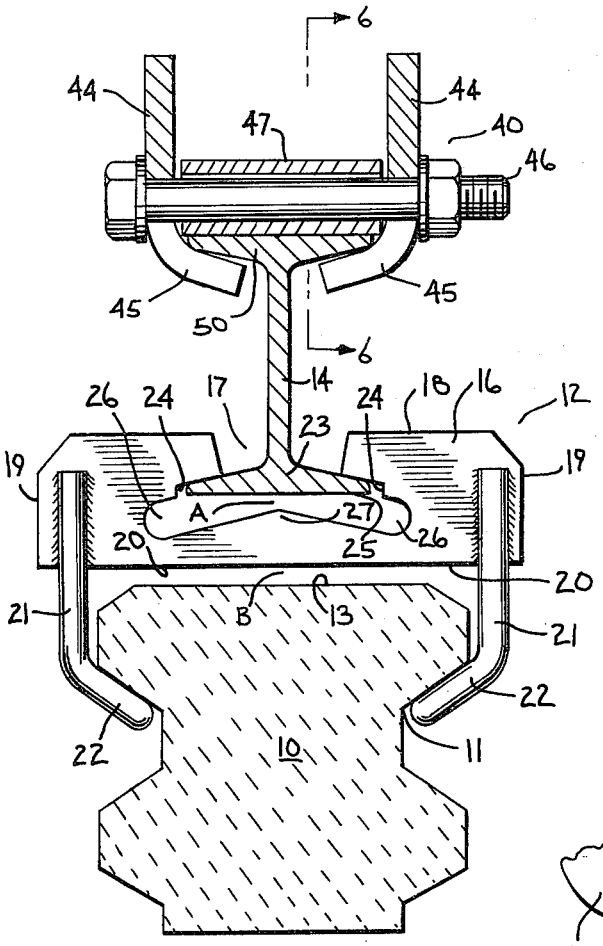
FIG. 1 is a cross-sectional view showing the tile hanger assembly engaging a refractory tile material suspended by the clamping assembly in accordance with the present invention.

Referring now to the drawings wherein like numerals have been used throughout the several views to designate the same or similar parts, FIG. 1 illustrates the mounting of a refractory tile material 10 by an arch tile hanger assembly 12 to a suspended I-beam structure 14. As shown in FIGS. 1, 3 and 4, the tile hanger assembly 12 is comprised of a pair of vertically spaced apart plates 16 having a cutout portion 17 in the upper edges 18 in each of the vertical spaced apart plates 16. Welded or otherwise mounted adjacent the ends 19 of plates 16 are a pair of U-shaped rods 21. The bight portions 22 of the U-shaped rods 21 are turned inwardly toward one another to engage and hold the refractory tile material 10 within the notched portions 11 of the tile material 10.

Figure 2:
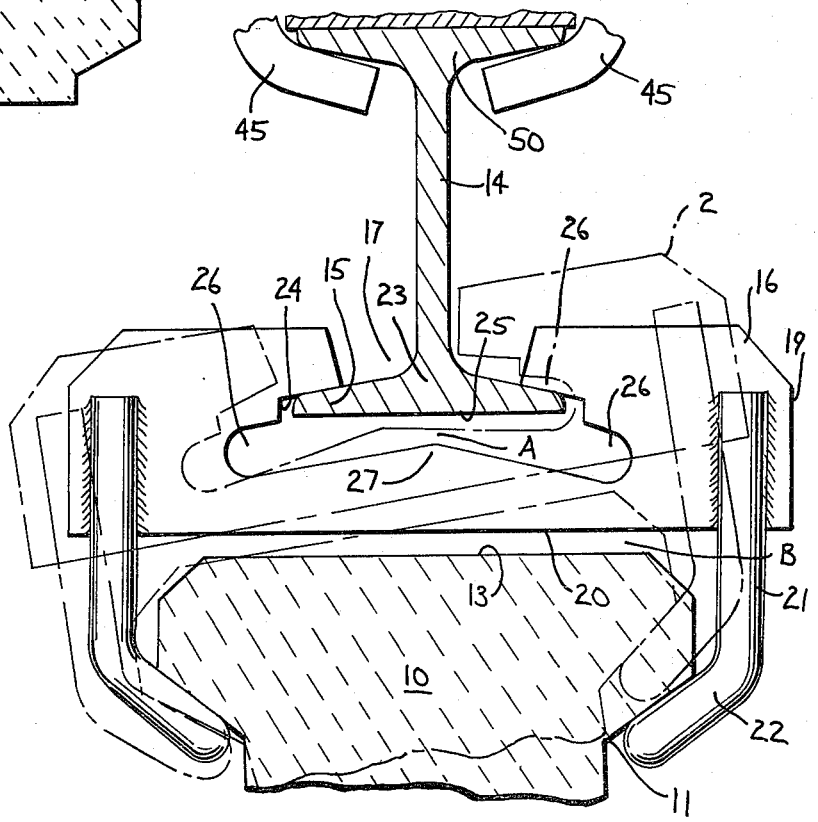
FIG. 2 is an enlarged cross-sectional view showing the positioning of the tile hanger assembly about the lower portion of an I-beam in accordance with the present invention.

The cutout portion 17 (FIG. 2) in each of the vertical spaced apart plates 16 is shaped to include overhang portions 24 which engage the ends 15 of the lower horizontal portion 23 of the I-beam 14. The cutout portion 17 in each of the spaced apart plates 16 includes clearance areas 26 which permit and facilitate positioning the tile hanger 12 about the lower horizontal portion of the I-beam 14. As shown in phantom position 2 in FIG. 2, the tile hanger assembly 12 can be rotated such that the I-beam ends 15 will be extended into the clearance area 26 of the cutout portion 17 to thereby permit positioning of the hanger assembly 12 about the lower horizontal portion 23 of the I-beam 14. Moreover, the size of the cutout 17 permits a given tile hanger 12 size to be positioned about of plurality of cross-sectional sized I-beams. The clearance between the convex-like projection 27, extending inwardly into the cutout portion 17 from the side of plates 16, provides the proper reduced clearance between the tile hanger assembly 12 and the bottom surface 25 of the lower horizontal portion 23 of the suspended I-beam 14 to prevent disengagement or skewing of the assembly during both the installation of the monolithic refractory material and during operation of the furnace structure. After positioning the tile hanger to the I-beam, the refractory tile 10 is inserted into and engaged by bight portions 22, a position as shown in FIG. 1. Additionally, when the refractory tile 10 is positioned onto bight portions 22, a clearance 13 is provided between the top surface 13 of the tile 10 and the lower edge 20 of the vertically spaced apart plates 16. This clearance prevents damage to the tile 10 during installation and during operation of the furnace structure.

FIG. 5 illustrates an alternate construction and assembly of the tile hanger assembly 12 which does not require welding or fixedly mounting the U-shaped rods 21 to the vertically spaced apart plates 16. As shown in FIG. 5, the tile hanger assembly 12 includes a U-shaped plate 28 having vertically spaced apart plates 16 extending upwardly from a base 29. The vertically spaced apart plates 16 include a cutout portion 17 in the upper edges 18 thereof and which are aligned with respect to one another and which are adapted to receive the lower horizontal portion of the I-beam 14. The cutout portion 17 of the vertically spaced apart plates 16 is identical in construction with that described above with respect to the embodiment shown in FIGS. 1–4 and includes overhang portions 24 which engage the ends 15 of the I-beam 14 when the tile hanger assembly 12 is engageable with the lower portion of the I-beam 14. The cutout portion 17 includes also clearance areas 26 which facilitate positioning of the tile hanger assembly 12 about the horizontal end portion 15 of the I-beam 14. Also, although not shown in assembled relation, the convex-like projection 27, extending inwardly into the cutout portion 17 provides the proper reduced clearance between the tile hanger assembly and the bottom surface 25 of the lower horizontal portion 23 of the suspended I-beam 14 to prevent disengagement or skewing of the assembly during both the installation of the monolithic refractory material and during operation of the furnace structure.

The base 29 of the U-shaped plate 28 includes an end extension 30 thereon having recesses 32 along the outer edge thereof which are adapted to receive the U-shaped rods 21, as will hereinafter be described. The vertically spaced apart plates 16 of the U-shaped plate 28 includes a plurality of cutouts 34 having detent lip projections 35 extending inwardly from the vertical spaced apart plates 16. The ends 33 of the U-shaped rods 21, opposite the bight portions 22 thereon, are inserted past the recesses 32 on the end extensions 30 of the U-shaped plate 28 and are pivoted about the recess 32 such that the ends 33 engage the lip detent members to reset to a position in the corner of the U-shaped plate 28. The U-shaped rods 21 include an intermediate bight portion which is shown turned inwardly and facing one another to engage the notched portions 11 of the refractory tile material 10, as has heretofore been described. The simple and unique construction of the tile hanger 12 as shown in FIG. 5 provides a tile hanger which is simple to assemble and does not require welding of parts together. All that is necessary is a punching operation to preform the plate 28 and the rods 21 to assemble the tile hanger 12. Additionally, such a hanger is of a rigid construction which is adapted to be positioned about a plurality of cross-sectional sized I-beams.

When the overhead steel supporting structure of the roof of the furnace structure is comprised of existing I-beam structures, it is only necessary to utilize the unique tile hanger assembly 12 in suspending the refractory tile material 10, as has heretofore been described. However, in many furnace structures, the overhead steel supporting structure is not comprised of I-beam construction steel work, but rather is comprised of overhead steel plates. When the furnace structure is of such a construction, it is applicant's intention to describe and disclose in FIGS. 1 and 6 a clamping member or means 40 which is attached to or rests upon the overhead steel supporting structure 42 (FIG. 6), as will hereinafter be described. The clamping member or element 40 is comprised of a pair of adjustably spaced leg portions 44 having lower inturned end portions 45 which receive and support the upper horizontal portions 50 of an I-beam 14. Each of the adjustably spaced leg portions 44 have an opening 49 therein which is adapted to receive a bolt stem 46 and spacer 47. The member 40 may either be mounted directly to an overhead steel supporting structure (not shown) or include a projection portion 45 thereon which is adapted to rest upon an extension 43 of the overhead steel supporting structure 42, as shown in FIG. 6. Preferably, the length of the spacer 47 is of a predetermined length such that the inturned leg portions snugly receive and support the horizontal portions of the I-beam 14 to suspend the same to permit the hanging of the refractory tile material 10 to the roof or ceiling of the furnace structure, as has heretofore been described.

Importantly, in the tile hanger assembly 12, it is only necessary that the rods be comprised of a high-temperature alloy which will withstand the high temperatures within the furnace structure. The spaced apart plates 16 may be comprised of common structural steel to provide a completed assembly at a minimum of cost that is reusable over and over again.

The composition of the refractory tile material is well known to those skilled in the art and when the tile refractory material 11 is suspended by the tile hanger assembly 12 to the roof or ceiling of the furnace structure, a plastic form of refractory material is then installed between the refractory tile material by a steel hammer or air rammer or is filled with a castable refractory material which is installed by a prepared formwork. Once installed, the plastic refractory material is baked to form a monolithic furnace lining which eliminates leaky joints, reduces spalling, prevents air infiltration and provides effective heat radiation within the furnace structure.

We claim:

1. A tile hanger assembly for anchoring refractory tile material to the roof of a furnace structure, including in combination;

an I-beam member having upper and lower horizontal portions, a clamping member engageable with the roof of the furnace structure, said clamping member including a pair of adjustably spaced leg portions having lower inturned end portions which are adapted to engage and support said upper horizontal portion of said suspended I-beam, fastening means engageable with each of the adjustably spaced leg portions and the roof of the furnace for mounting the spaced leg portions to the roof of the furnace structure, and tile anchor means comprised of a pair of vertically spaced apart plates each having aligned cutouts in the upper edges thereof which are adapted to engage said lower horizontal portion of said suspened I-beam and each having lower edges, a pair of rods each having an intermediate bight portion turned inwardly and facing one another, said ends of said rods being mounted to the ends of said vertically aligned plates, with said intermediate bight portion adapted to yieldingly engage the refractory tile material to suspend the same in a substantially vertical position between said bight portion and said lower edges of said plates without placing a pinching stress on the tile material.

2. The tile hanger assembly in accordance with claim 1 wherein said pair of rods are U-shaped.

3. The tile hanger assembly in accordance with claim 1 wherein said spaced apart plates include overhang portions being engageable with said lower horizontal portion of said I-beam for positioning said tile anchor means and the tile material substantially in a vertical position.

* * * * *